United States Patent [19]

Daly

[11] Patent Number: 5,070,844

[45] Date of Patent: Dec. 10, 1991

[54] COMPOSITE FUEL RAIL SOCKET FOR BOTTOM- AND SIDE-FEED FUEL INJECTORS

[75] Inventor: Paul D. Daly, Troy, Mich.

[73] Assignee: Siemens Automotive L.P., Auburn Hills, Mich.

[21] Appl. No.: 556,767

[22] Filed: Jul. 23, 1990

[51] Int. Cl.[5] ..... F02D 31/00

[52] U.S. Cl. ..... 123/456; 123/468; 123/470

[58] Field of Search ..... 123/456, 469, 468, 470, 123/472

[56] References Cited

U.S. PATENT DOCUMENTS

| | | | |
|---|---|---|---|
| 3,845,748 | 11/1974 | Eisenburg | 123/468 |
| 4,294,215 | 10/1981 | Hans et al. | 123/469 |
| 4,693,223 | 9/1987 | Eshleman et al. | 123/470 |
| 4,751,904 | 6/1988 | Hudson, Jr. | 123/456 |
| 4,768,487 | 9/1988 | Yamamoto et al. | 123/470 |
| 4,844,036 | 7/1989 | Bassler et al. | 123/456 |
| 4,860,710 | 8/1989 | Hafner et al. | 123/469 |
| 4,913,119 | 4/1990 | Usui | 123/468 |
| 4,996,962 | 3/1991 | Usui | 123/468 |

*Primary Examiner*—E. Rollins Cross
*Assistant Examiner*—Tom Moulis
*Attorney, Agent, or Firm*—George L. Boller; Russel C. Wells

[57] ABSTRACT

The injector is mechanically retained in the molded composite socket member by an annular cap that is threaded onto the end of the socket member containing the end of the through-bore into which the injector was inserted. The sidewall of the cap contains an internal helical thread that threads to an external helical thread on the exterior of the socket member. The cap stiffens the socket wall at the thread to strengthen the socket wall against circumferential expansion caused by the pressure of fuel in an annular space that surrounds the injector interior of the socket through-bore. A method for making the cap and joining it to the socket member is also disclosed.

15 Claims, 3 Drawing Sheets

COMPOSITE FUEL RAIL SOCKET FOR BOTTOM- AND SIDE-FEED FUEL INJECTORS

BACKGROUND AND SUMMARY OF THE INVENTION

This invention relates to a fuel rail assembly that is used to deliver fuel to individual cylinders of an internal combustion engine.

In certain electromagnetic fuel injectors the fuel inlet is located such that fuel is introduced radially of the injector longitudinal axis. Such injectors are sometimes called "side-feed" or "bottom-feed" injectors, and one significant benefit of using these types of injectors is a reduction in the size of the packaging envelope in the engine compartment of an automobile.

For testing and installation purposes, automobile manufacturers desire electromagnetic fuel injectors to be part of a self-contained fuel rail assembly which can be mounted as a unit to an engine. A fuel rail assembly for side- or bottom-feed injectors does not readily lend itself to the metal fabrication techniques commonly used at present in fuel rail manufacture. Fabrication of a fuel rail for side- or bottom-feed injectors by using composite (plastic/glass/mineral) fabrication procedures is therefore desirable. It is toward such a composite fuel rail assembly for side- or bottom-feed electromagnetic fuel injectors that the present invention is directed.

One significant difference that typically exists between a "top-feed" injector and a side- or bottom-feed one is that the relative proportions are appreciably different. Overall, a side- or bottom-feed injector is generally shorter but not narrower than a top-feed injector. A necessary consequence of such a fact is that a fuel rail socket which receives a side- or bottom-feed injector must, at least in certain regions, be greater in diameter than a comparable socket for a top-feed injector. Since injectors for a given usage application are often exposed to comparable fuel pressures regardless of injector type, an injector-receiving socket of a fuel rail that is dimensioned for acceptance of a side- or bottom-feed type injector is apt to incur substantially higher maximum pressure-induced hoop forces than would be the case if it were dimensioned for acceptance of a top-feed type injector. In order to guard against unacceptably high magnitudes of maximum stress in the socket, the wall thickness of each region of the socket must be sufficiently large that the anticipated maximum stress that will occur therein is kept to a tolerable level. Since the typical socket also has multiple shoulders that create regions of different diameters in the socket, it becomes impossible to maintain a reasonably even stress field throughout the socket unless the socket wall thickness of each different diameter region is made unique to that particular region.

Yet, an important consideration which must be taken into account in the successful application of composite molding technology to the fabrication of a fuel rail assembly for an automotive internal combustion engine is the maintenance of generally uniform wall thickness throughout. In the absence of such maintenance, the resulting product may be prone to unacceptably high molded-in stresses and to unacceptably large deformation due to uneven shrinkage. Hence, although not all regions of a fuel rail socket may necessarily experience the same maximum hoop forces, successful molding considerations are likely to result in the requirement that thicknesses of certain regions which experience lower maximum forces than other regions be significantly greater than would be mandated by stress considerations if only the latter held sway. Therefore, for any given fuel rail configuration, the total amount of composite actually molded per rail is greater than that required on the basis of stress considerations alone. Accordingly, there exists a potential for a more efficient use of composite in a molded fuel rail, and it is that potential which is tapped by the present invention.

After an injector has been seated in its fuel rail socket, it is desirable that the injector be mechanically retained or captured in some manner. One aspect of the invention involves the use of such a mechanical retention for the additional purpose of strengthening the socket at a region of maximum hoop force in such a way that a molded composite fuel rail may make more efficient use of composite material. Favorable cost and weight implications accrue.

Another aspect of the invention involves a method for fabricating the mechanical injector-retention part and joining it to the injector-containing socket.

A further aspect of the invention relates to the construction of the joint which the injector-retention part provides between the injector-containing socket and an electrical connector plug that connects an electric control circuit to the electrical terminals of the injector when the fuel rail is functionally installed on an engine.

The foregoing, together with further details and advantages of the invention, will be seen in the ensuing description and drawings, which present a presently preferred embodiment according to the best mode contemplated at this time for the practice of the invention.

DESCRIPTION OF THE PREFERRED EMBODIMENT

Figure 1:
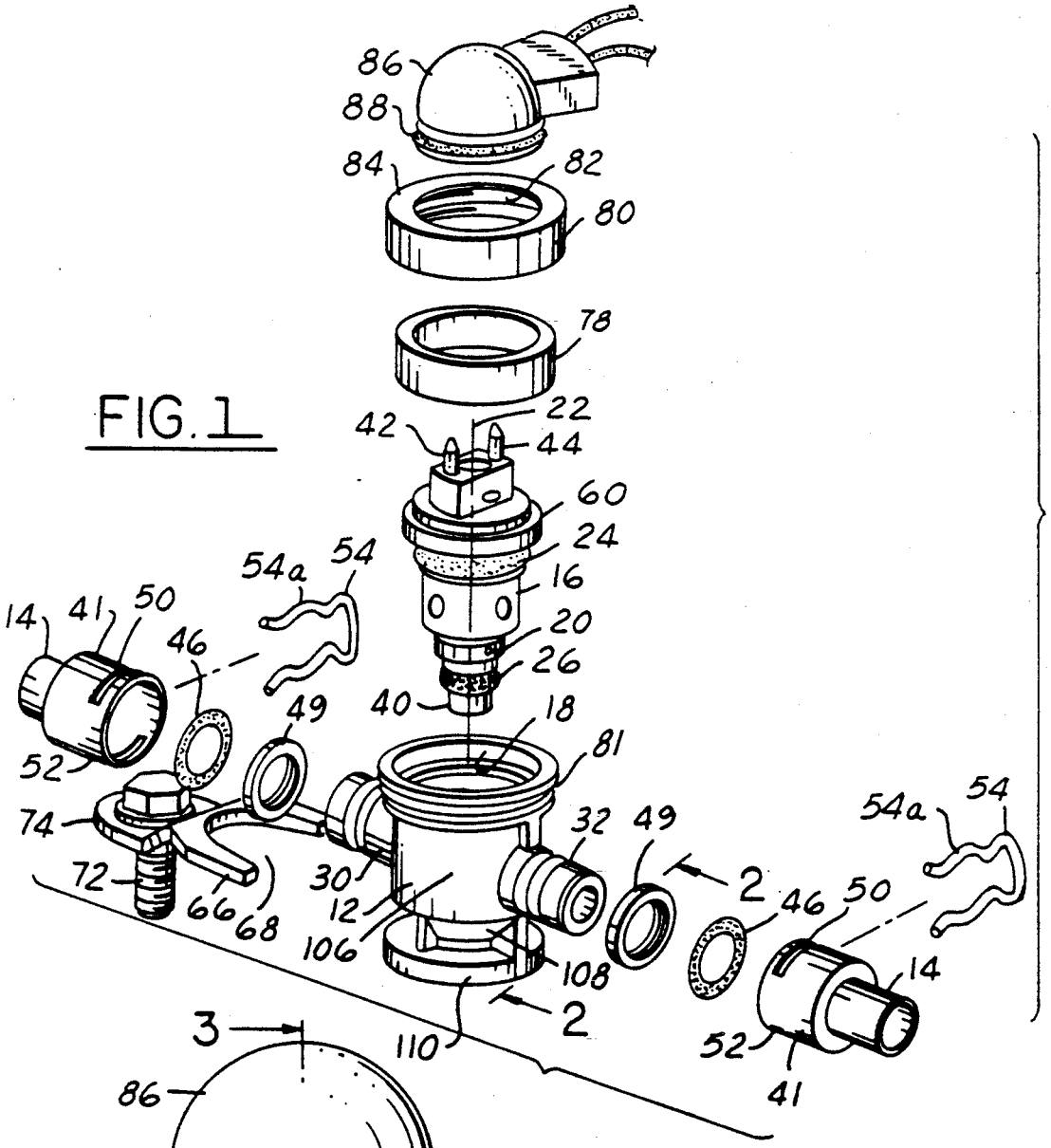
FIG. 1 is a fragmentary exploded perspective view of a portion of a fuel rail assembly according to the invention.
Figure 2:
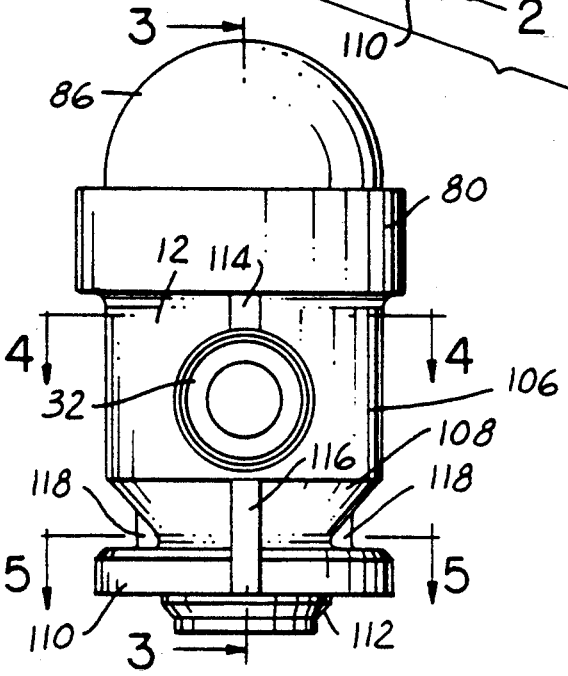
FIG. 2 is a view looking in the direction of arrows 2—2 in FIG. 1, but showing the parts in assembly relation.
Figure 1A:
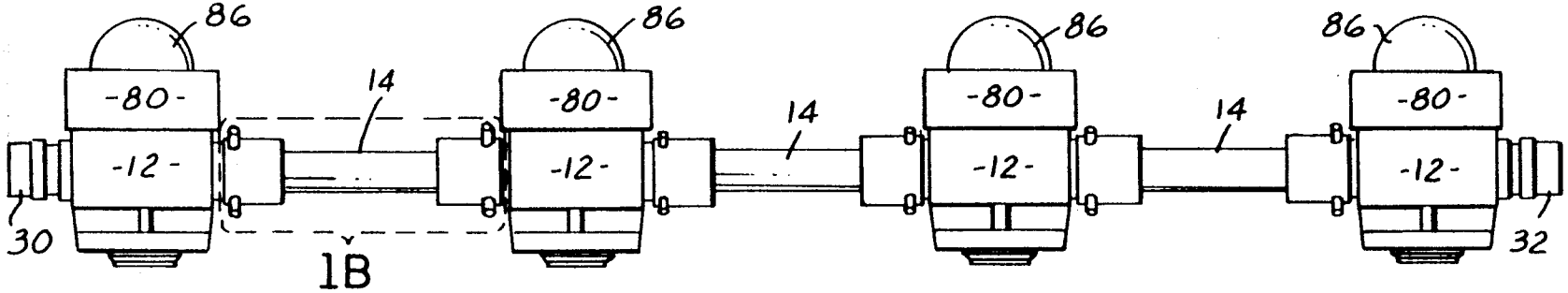
FIG. 1A is a longitudinal view of the fuel rail assembly.

FIG. 1A shows a fuel rail assembly 10 comprising a plurality of rigid composite injector-receiving socket members 12 which are connected together in a straight row by rigid straight metal tubes 14 (steel for example) to form the fuel rail assembly. The composite comprises a plastic/glass/mineral composition. Further details appear in FIGS. 1, 1B, 1C, and 2-6.

An individual electromagnetic fuel injector 16 of the side-feed type is disposed within the main injector-receiving through-bore 18 of each member 12. The fuel injector comprises one or more side inlet openings 20 which may be covered by a filter element and via which pressurized liquid fuel enters the injector. Such inlet opening(s) 20 is (are) located axially along the longitudinal axis 22 of the injector between two axially spaced apart o-ring seals 24 and 26 which seal between the outside of the injector and the wall of bore 18 to form an annular fuel space 28 around the injector within the socket bore.

Each socket member 12 has a pair of integral nipples 30 and 32 respectively which project radially outwardly relative to axis 22 on diametrically opposite sides of the injector. These nipples are in communication with space 28. Immediately adjacent socket members 12 are connected together, as shown in FIG. 1A, by means of a corresponding metal tube 14 extending between the nipple 32 of a left-hand member 12 and the nipple 30 of a right-hand member 12. With the fuel rail assembly functionally installed on an engine, the nipple 30 of the left-hand-most member 12 and the nipple 32 of the right-hand-most member 12 are connected with suitable respective conduits (not shown) to provide for the ingress of liquid fuel into the rail to fill spaces 28 and for the egress of return fuel to tank. In use, fuel is introduced into the fuel rail assembly at the inlet port (at one end of the assembly for example) and delivered through metal tubes 14 to annular spaces 28, with the excess return fuel being conducted out of the fuel rail assembly at the return port (at the opposite end of the assembly for example). The example of fuel rail assembly that is presented in the drawings is representative of a four injector configuration for serving a bank of four engine cylinders, and it should be understood that principles of the invention may be embodied in virtually any configuration desired to accommodate different engines. In accordance with conventional practice, the fuel rail assembly may also have mounting provision (not shown) for a fuel pressure regulator.

The bore 18 of each socket member 12 is shaped to receive an injector and is larger at the top than at the bottom. Each injector is assembled into the corresponding member 12 by inserting the nozzle end 40 of the injector through the open top of bore !8 and seating the injector in the bore in the manner shown by FIG. 3. A seated injector is mechanically retained in its socket by means of a cap and a spacer which will be described later. In the seated position of an injector within a socket bore, the nozzle end of the injector can emit fuel out of the socket and into an intake passage to the individual cylinder with which the injector is associated. Such injection takes place when the injector is energized by an electric current pulse delivered via an electrical wiring connector (hereinafter to be described) connected to electrical terminals 42 and 4 located at the end of the injector axially opposite nozzle end 40. When an injector is energized, pressurized fuel in the corresponding fuel space 28 passes through inlet opening(s) 20 and the interior of the injector to be emitted at the nozzle end 40.

Figure 1B:
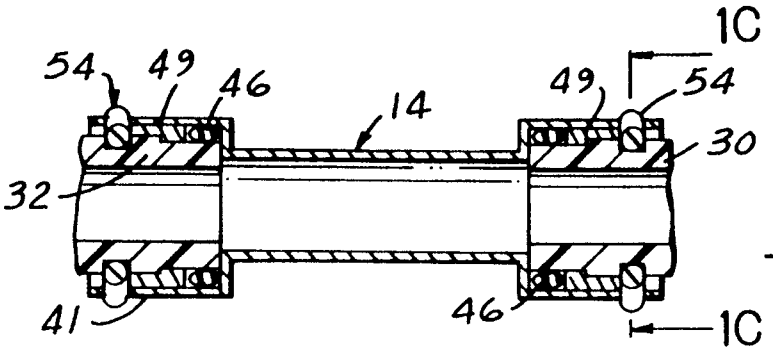
FIG. 1B is a cross-sectional view taken within the broken line labeled 1B in FIG. 1A.
Figure 1C:
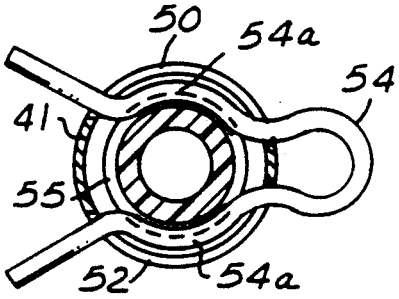
FIG. 1C is a transverse cross-sectional view in the direction of arrows 1C—1C in FIG. 1B.

At each of its axial end connections to a socket member nipple, each metal tube 14 is diametrically enlarged for fitting over the end of the nipple in a telescopic manner. For purposes of making each such joint fluid-tight, there is an O-ring seal 46 that is fitted onto the reduced end portion 48 of the nipple after a back-up washer 49 for the O-ring has been placed onto the nipple. The enlarged axial end portion 41 of each tube comprises a pair of arcuate slots 50 and 52 disposed in opposite semi-circumferences. In the fuel rail assembly 10, a hairpin clip 54 is pushed radially onto each enlarged tube end in registry with slots 50 and 52 so as to capture the tube on the nipple in the manner shown by FIG. 1C. Each leg of the hairpin clip fits into a corresponding one of the slots 50 and 52 and lodges in a portion of a circular groove 55 in the outside wall of the nipple. A medial portion **54*a* of each leg of the hairpin clip is shaped for conformance with the diameter of the bottom of groove 55**, as seen in FIG. 1C.

Assembly of the fuel rail to an engine is accomplished by utilizing at each member 12 a mounting bracket 66 (FIG. 1). Each bracket comprises a notched-out tongue portion 68 that fits radially onto member 12 and can be drawn axially toward the engine to clamp flange region 110 (to be described later) of member 12 against the engine when a screw 72 that passes through a hole in another portion 74 of bracket 66 is threaded into a hole in the engine and tightened. Preferably an O-ring seal 76 (FIG. 3) provides a seal of the member 12 to the engine around the point of fuel introduction into the engine.

Each injector is captured in its seated position within the corresponding socket member 12 by means of an annular metal retention cap 80 and an annular spacer 78. This forces flange 60 of the injector against shoulder 61 of through-bore 18.

Around the upper end of bore 18, the outside of member 12 is provided with an external screw thread 81, and cap 80 has a complementary internal screw thread 82. The spacer is placed over the injector, and cap 80 is tightened onto the top of member 12 to axially compress the spacer 78 between shoulder 60 of the injector and the radially inwardly directed flange 84 of cap 80. Finally, an electrical connector 86 is fitted onto the assembly to connect terminals 42 and 44 and to close the open area which is circumscribed by the annular cap and spacer. The joint at this larger end of the socket, said joint consisting of the annular injector-retention structure, the electrical connector and the injector terminal end, advantageously includes a circumferentially extending ring 88 disposed in a circular groove extending around the outside of connector 86. The ring resiliently slightly contracts during the step of attaching the connector to the injector terminals so that in the completed installation depicted by FIG. 3 it applies a radially outwardly directed force against the I.D. of spacer 78 to aid in maintaining the installed connector on the injector and in resisting intrusion of foreign matter between the spacer I.D. and the outside portion of the connector that fits into the annular injector retention structure. The ring can be either an elastomeric O-ring or a split metal snap-ring. While the drawing shows spacer 78 to be a separate part, it can be integrated into either injector 16 or cap 80, if desired. The material of the spacer can be either a suitable metal or plastic.

While cap 80 can obviously be pre-fabricated from metal or other material to its final shape before it is installed on a socket, one of the several aspects of the invention contemplates the fabrication of the cap to its final shape during the step of installing it on a socket. By an appropriate design for the socket thread 81, and with the use of certain machinery, the cap's screw thread 82 is created during the cap's installation on the socket.

Thread 81 was integrally formed during the process of molding the socket member so as to be a coarse pitch helix, for instance a pitch of three to ten threads per inch. It is of an open type profile, typically a semi-circle. Cap 80 is fabricated from this metal (steel, for instance) and is initially formed with its circular, cylindrical sidewall unthreaded and of an I.D. allowing it to just fit over the crest of thread 81. The machinery for creating the thread in the cap is schematically portrayed in phantom in FIG. 3 and comprises metal rollers 100 of suitably shaped and sized O.D. arranged at particular locations around the outside of the cap with their axes parallel to axis 22. The rollers 100 are on a head (not shown) which is placed over the socket and cap after the unthreaded cap has been fitted over the larger axial end of socket member 12. With the fuel rail having been suitably fixtured on the machinery, the head functions as follows. A portion of the head urges the radial flange 84 of the cap toward the socket so that acting through spacer 78, the injector is forcefully held seated in the socket bore. While the cap is thusly held and constrained against rotation, the imaginary circle on which the rollers lie is contacted to bring the rollers into tangential contact with the still unthreaded sidewall of the cap. The rollers are at proper axial locations along axis 22 to align with the root of thread 81. The rollers are then forced radially inwardly against the sidewall of the cap, and the portion of the head that contains the rollers is caused to follow a helical path of motion corresponding to the helix of thread 81. This creates the complementary thread 82 in the cap's sidewall. The rollers could alternately be spring-biased against the unthreaded cap sidewall to "find" the portion of the unthreaded sidewall that overlies the root of thread 81. A further alternative is to create the cap thread by forcing a pair of dies against opposite semi-circumferences of the unthreaded cap sidewall.

The socket members are preferably fabricated by an injection molding process, using materials suitable for the particular fuel or fuels to be handled by the fuel rail assembly. For gasoline, plastics such as nylon are suitable. The use of composite for the socket members can provide manufacturing and weight advantages, particularly when compared to metal sockets. It can be seen in the several drawing Figs. that the wall thickness of the socket member, including its sidewall and nipple walls, is generally uniform throughout. The socket sidewall has a straight circular, cylindrical region 106 immediately contiguous thread 81, and it is this region from which nipples 30 and 32 extend. The socket sidewall also has a frusto-conical shaped region 108 leading to a circular flange region 110 beyond which is an end region 112. Circumferentially spaced apart, axial stiffening ribs are integrally formed on the exterior of the socket member. There are ribs 114 and 116 diametrically opposite each other at the intersection of each nipple 30, 32 with the axially extending socket sidewall and they merge with the nipples and the socket sidewall. There are also ribs 118 at merger of regions 108 and 110, 90 degrees from ribs 116. The thicknesses of the ribs and of flange region 110 are also substantially the same as those of the socket member's sidewall and nipple walls.

The use of rigid metal for the connecting tubes provides a certain rigidity to the fuel rail assembly, yet the nature of the joints between the connecting tubes and the sockets endow the assembly with the ability to properly conform to an engine mounting even if, at the beginning of the step of attaching the fuel rail assembly to the engine, there are certain slight misalignments of the longitudinal axes of the injector-containing socket members to those of the corresponding engine manifold inlets onto which they fit. Moreover, the invention contemplates an assembly in which the connecting tubes are curved, an assembly which serves a V-type engine, an assembly in which the joints are modified such that the socket nipples telescope over the ends of the connecting tubes, and an assembly in which the longitudinal axes of the socket members are not necessarily all parallel.

Figure 7:
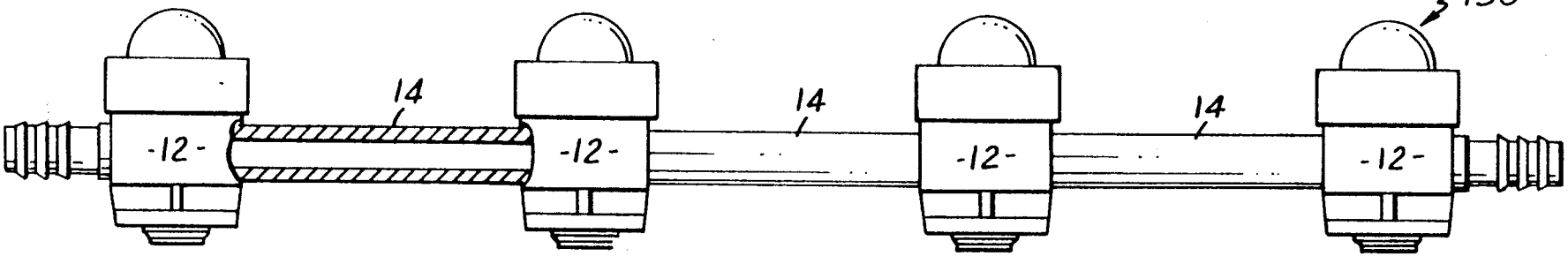
FIG. 7 is a longitudinal view of another embodiment of fuel rail.
Figure 3:
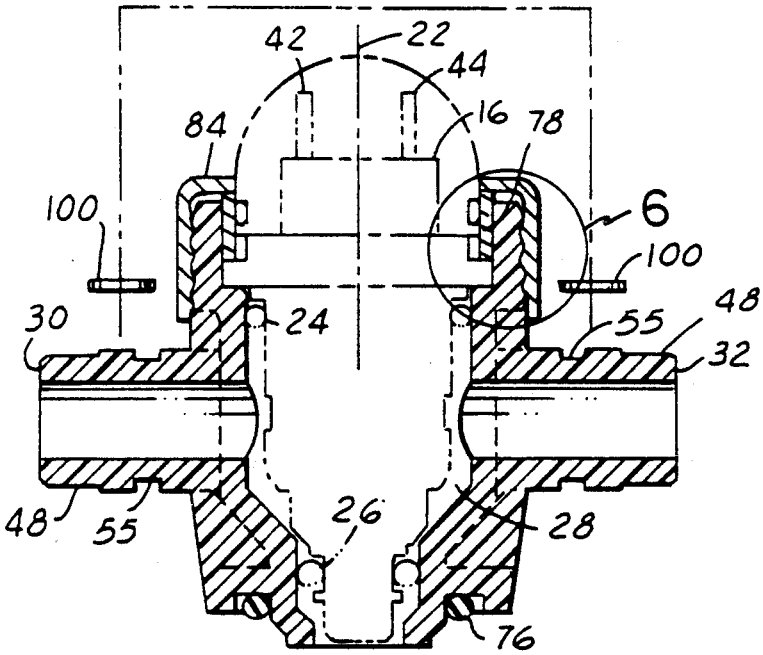
FIG. 3 is a longitudinal sectional view taken in the direction of arrows 3—3 in FIG. 2, certain parts being either omitted or else shown in phantom.
Figure 6:
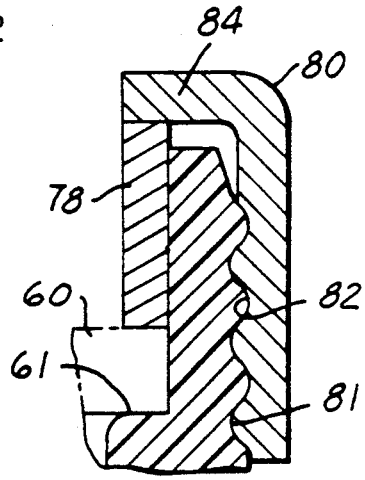
FIG. 6 is an enlarged view in circle 6 of FIG. 3.
Figure 4:
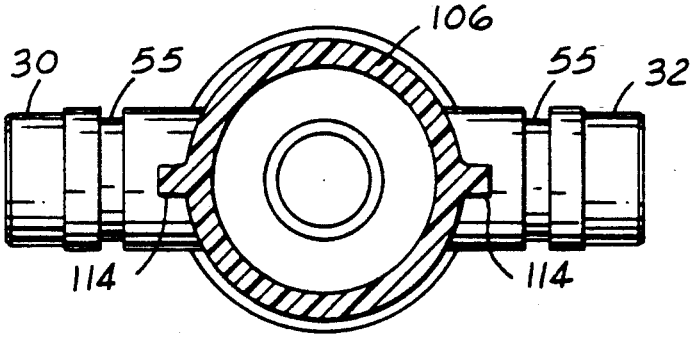
FIG. 4 is a transverse cross-sectional view taken in the direction of arrows 4—4 in FIG. 2 of one of the parts by itself.
Figure 5:
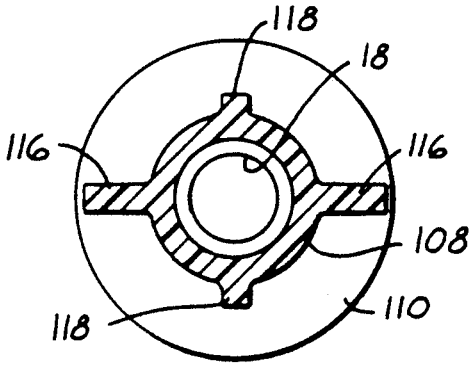
FIG. 5 is a transverse cross-sectional view taken in the direction of arrows 5—5 in FIG. 2 of one of the parts by itself.

FIG. 7 illustrates a fuel rail assembly 130 in which the socket members 12 and the tubes 14 that connect the sockets together are a single molded composite part.

Thus, the invention has been shown to provide an improved internal combustion engine fuel rail assembly especially adapted for use with side- or bottom-feed electromagnetic fuel injectors. While a presently preferred embodiment has been disclosed, it is to be understood that the inventive principles may be put into practice in other equivalent forms.

What is claimed is:

1. A fuel rail assembly for an internal combustion engine comprising a plurality of non-metallic socket members, each having a through-bore shaped to receive and seat a corresponding electromagnetic fuel injector, the receipt of such a fuel injector in each through-bore being via an open axial end thereof, the seated fuel injector and through-bore of the socket member cooperatively defining an annular-shaped fuel space with which a fuel inlet of the seated injector is in communication, and mechanical retention means coacting with said each socket member at said open axial end thereof for retaining the corresponding injector seated, characterized in that:

said mechanical retention means comprises an annular cap having a sidewall containing an internal helical thread that is tightened to a complementary external helical thread on a sidewall portion of the corresponding socket member which is at said open axial end of the socket member's through-bore so as to strengthen said sidewall portion against circumferential expansion urged by the pressure of fuel in the corresponding annular-shaped fuel space, and means for reacting against the seated injector the force of tightening said cap on said sidewall portion so as to cause a force to be applied to the seated injector in a sense that maintains the injector seated.

2. A fuel rail assembly as set forth in claim 1 further characterized in that said means for reacting against the seated injector the force of tightening said cap on said sidewall portion so as to cause a force to be applied to the seated injector in a sense that maintains the injector seated comprises a radially inwardly directed flange on said cap that radially overlaps said sidewall portion of the socket member and means extending from said flange of said cap axially into the through-bore for engaging the injector.

3. A fuel rail assembly as set forth in claim 2 further characterized in that said means extending from said flange of said cap axially into the through-bore for engaging the injector comprises an annular-shaped spacer.

4. A fuel rail assembly as set forth in claim 3 further characterized in that said annular-shaped spacer is a separate part that is not integrally formed with said cap.

5. A fuel rail assembly as set forth in claim 4 further characterized in that said cap is metal.

6. A non-metallic socket member having a through-bore shaped to receive and seat an electromagnetic fuel injector for injecting fuel into an internal combustion engine, the receipt of such a fuel injector in said through-bore being via an open axial end thereof, the seated fuel injector and through-bore of the socket member cooperatively defining an annular-shaped fuel space with which a fuel inlet of the seated injector is in communication, and mechanical retention means coacting with said socket member at said open axial end thereof for retaining the injector seated, characterized in that:

said mechanical retention means comprises an annular cap having a sidewall containing an internal helical thread that is tightened to a complementary external helical thread on a sidewall portion of said socket member which is at said open axial end of said through-bore so as to strengthen said sidewall portion against circumferential expansion urged by the pressure of fuel in said annular-shaped fuel space, and means for reacting against the seated injector the force of tightening said cap on said sidewall portion so as to cause a force to be applied to the seated injector in a sense that maintains the injector seated.

7. A fuel rail assembly as set forth in claim 6 further characterized in that said means for reacting against the seated injector the force of tightening said cap on said sidewall portion so as to cause a force to be applied to the seated injector in a sense that maintains the injector seated comprises a radially inwardly directed flange on said cap that radially overlaps said sidewall portion of said socket member and means extending from said flange of said cap axially into said through-bore for engaging the injector.

8. A fuel rail assembly as set forth in claim 7 further characterized in that said means extending from said flange of said cap axially into said through-bore for engaging the injector comprises an annular-shaped spacer.

9. A fuel rail assembly as set forth in claim 8 further characterized in that said annular-shaped spacer is a separate part that is not integrally formed with said cap.

10. A fuel rail assembly as set forth in claim 9 further characterized in that said cap is metal.

11. A non-metallic socket member comprising a sidewall bounding a through-bore for receiving via an open axial end thereof and for seating therein an electromagnetic fuel injector for injecting fuel into an internal combustion engine, characterized in that the thickness of said sidewall is generally uniform throughout, and on the exterior of said sidewall there is at least one stiffening rib having a thickness substantially the same as that of said sidewall for stiffening said sidewall, and characterized further in that the socket member includes at least one tube that is integral with and projects radially outwardly from said sidewall, that has a wall thickness substantially the same as that of said sidewall, and that is in fluid communication with said through-bore, and said at least one stiffening rib stiffens the merger of said tube with said side wall.

12. A non-metallic socket member comprising a sidewall bounding a through-bore for receiving via an open axial end thereof and for seating therein an electromagnetic fuel injector for injecting fuel into an internal combustion engine, characterized in that the thickness of said sidewall is generally uniform throughout, and on the exterior of said sidewall there is at least one stiffening rib having a thickness substantially the same as that of said sidewall for stiffening said sidewall, and characterized further in that said sidewall comprises a straight cylindrical region and a frusto-conically shaped region, and said at least one stiffening rib stiffens the merger of said regions.

13. A socket member as set forth in claim 12 characterized further in that said socket member comprises a circumferentially extending flange region adjacent said frusto-conically shaped region and integral with said sidewall around the exterior thereof, and said at least one stiffening rib stiffens the merger of said flange with said sidewall including said frusto-conically shaped region.

14. A non-metallic socket member having a through-bore shaped to receive and seat an electromagnetic fuel injector for injecting fuel into an internal combustion engine, and in fact containing such a fuel injector, the receipt of said fuel injector in said through-bore being via an open axial end thereof, the seated fuel injector and said through-bore cooperatively defining an annular-shaped fuel space with which a fuel inlet of the seated injector is in communication, tubing that is integrally formed with said socket member for communicating fuel to said fuel space, and mechanical retention means coacting with said socket member at said open axial end thereof for retaining the injector seated, characterized in that:

said mechanical retention means comprises an annular cap having a sidewall containing an internal helical thread that is tightened to a complementary external helical thread on a sidewall portion of said socket member which is at said open axial end of said through-bore so as to strengthen said sidewall portion against circumferential expansion urged by the pressure of fuel in said annular-shaped fuel space, and means for reacting against the seated injector the force of tightening said cap on said sidewall portion so as to cause a force to be applied to the seated injector in a sense that maintains the injector seated, said injector having electrical terminal means disposed in a terminal end portion thereof that protrudes through said cap, and including electrical connector structure separably fitted to said electrical terminal means of said injector for connecting said injector with a control circuit, said electrical connector structure comprising means closing an opening that exists between said cap and said terminal end portion of said injector.

15. A method for retaining an electromagnetic fuel injector in an injector-receiving socket member which comprises:

providing an injector-receiving socket member having a through-bore shaped to receive via one open axial end thereof and to seat therein an electromagnetic fuel injector and also having an external helical thread in a sidewall portion thereof that is adjacent said one open axial end of said through-bore;

inserting an electromagnetic fuel injector into said through-bore via said one open axial end and seating the injector therein;

disposing an injector-retaining means onto said socket member at said one open axial end to forcefully hold the injector seated, including externally overlapping said thread by means of an unthreaded metallic sidewall portion of said injector-retaining means that just fits over said thread; and then deforming said unthreaded metallic sidewall portion into an internal thread that is complementary with and threaded with the first-mentioned thread.

* * * * *